US011808267B2

(12) United States Patent
Helmis

(10) Patent No.: US 11,808,267 B2
(45) Date of Patent: Nov. 7, 2023

(54) ELECTRIC COOLANT PUMP

(71) Applicant: PIERBURG PUMP TECHNOLOGY GMBH, Neuss (DE)

(72) Inventor: Martin Helmis, Neuss (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 16/972,615

(22) PCT Filed: Jun. 8, 2018

(86) PCT No.: PCT/EP2018/065170

§ 371 (c)(1),
(2) Date: Dec. 7, 2020

(87) PCT Pub. No.: WO2019/233600

PCT Pub. Date: Dec. 12, 2019

(65) Prior Publication Data

US 2021/0239121 A1 Aug. 5, 2021

(51) Int. Cl.
*F04D 13/06* (2006.01)
*F04D 29/58* (2006.01)

(52) U.S. Cl.
CPC ..... *F04D 13/064* (2013.01); *F04D 29/5806* (2013.01); *F04D 13/0626* (2013.01); *F04D 29/5813* (2013.01); *F04D 29/5893* (2013.01)

(58) Field of Classification Search
CPC .... F04D 29/5806; F04D 13/025; F04D 13/06; F04D 13/0626; F04D 13/0693;
(Continued)

(56) References Cited

U.S. PATENT DOCUMENTS 3,085,513 A * 4/1963 Zimmermann ..... F04D 13/086 417/423.1
3,292,549 A * 12/1966 Nicoll ..... F04D 29/0413 310/90

(Continued)

FOREIGN PATENT DOCUMENTS

CN 2360650 Y * 1/2000
CN 103452857 A 12/2013

(Continued)

*Primary Examiner* — Dominick L Plakkoottam
(74) *Attorney, Agent, or Firm* — Norman B. Thot

(57) ABSTRACT

An electric coolant pump includes a pump housing, an electric motor, and a pump wheel. The pump housing has a pumping chamber and a motor chamber which are separated by a separation sidewall. The pumping chamber has a pump volute which extends from a pump inlet to a pump outlet. A volute cooling sector of the pump volute extends over a volute angle of 120°. The separation sidewall has a cooling section which is defined by the volute cooling sector. The electric motor includes a motor rotor, a motor stator having a stator coil arrangement, and a motor electronics arranged in the motor chamber which energizes the stator coil arrangement. The pump wheel is arranged in the pumping chamber and is connected with the motor rotor. The stator coil arrangement is arranged adjacent to the volute cooling sector and thermally contacts the cooling section of the separation sidewall.

9 Claims, 3 Drawing Sheets

(58) Field of Classification Search
CPC .. F04D 29/086; F04D 29/426; F04D 29/5813; F04D 29/5893
See application file for complete search history.

(56) References Cited

U.S. PATENT DOCUMENTS

| | | | | |
|---|---|---|---|---|
| 7,101,158 | B2 * | 9/2006 | Hembree | F04D 13/025 417/420 |
| 2005/0122074 | A1 * | 6/2005 | Gerfast | H02P 6/085 318/400.29 |
| 2006/0057005 | A1 | 3/2006 | Williams et al. | |
| 2006/0057006 | A1 * | 3/2006 | Williams | F04D 13/0633 417/423.14 |
| 2006/0245956 | A1 * | 11/2006 | Lacroix | H02K 7/14 417/423.1 |
| 2015/0326087 | A1 * | 11/2015 | Wang | H02K 5/08 417/423.7 |
| 2016/0201681 | A1 * | 7/2016 | Orue Orue | F04D 3/00 417/423.1 |
| 2016/0290364 | A1 | 10/2016 | Lee | |
| 2020/0309136 | A1 | 10/2020 | Helmis et al. | |

FOREIGN PATENT DOCUMENTS

| | | | | |
|---|---|---|---|---|
| CN | 105909532 | A | | 8/2016 |
| CN | 106050725 | A | | 10/2016 |
| DE | 3724219 | A1 | | 2/1988 |
| JP | H06280779 | A | * | 10/1994 |
| JP | H10-24192 | A | | 1/1998 |
| WO | WO 2017/220119 | A1 | | 12/2017 |

* cited by examiner

ELECTRIC COOLANT PUMP

CROSS REFERENCE TO PRIOR APPLICATIONS

This application is a U.S. National Phase application under 35 U.S.C. § 371 of International Application No. PCT/EP2018/065170, filed on Jun. 8, 2018. The International Application was published in English on Dec. 12, 2019 as WO 2019/233600 A1 under PCT Article 21(2).

FIELD

The present invention is directed to an electric coolant pump, for example, to an electric coolant pump for a motor vehicle.

BACKGROUND

A motor vehicle electric coolant pump is typically provided to circulate a coolant of a motor vehicle cooling circuit, primarily for cooling an internal combustion engine of the motor vehicle. The electric coolant pump must be reliable and failsafe in order to avoid damage to the internal combustion engine. Electric coolant pumps are typically designed to be very compact since the available space in a motor vehicle engine compartment is limited. Electric coolant pumps can, for example, be provided with an electric motor with a compact stator coil arrangement which requires only a small space for the motor stator. The compact stator coil arrangement must, however, be driven with a high drive energy density to provide a high mechanical pump performance. The high energy density in the stator coil arrangement generates significant heat which is caused by resistive heating. The generated heat must be efficiently dissipated to avoid an overheating of the electric motor, in particular of a heat sensitive motor electronics, and to provide a high motor efficiency.

An electric coolant pump for a motor vehicle is described, for example, in WO 2017/220119 A1, which coolant pump is provided with a pump housing which defines a pumping chamber and a motor chamber. The pumping chamber is filled with coolant and comprises a radially inner pump inlet, a radially outer pump outlet, and a pump volute extending from downstream of the pump inlet to the pump outlet. The motor chamber is fluidically separated from the pumping chamber by a separation sidewall extending substantially in a radial plane. The coolant pump is provided with an electric motor with a rotatable motor rotor, a motor stator with a compact stator coil arrangement, and a motor electronics for energizing the stator coil arrangement. The stator coil arrangement is defined by a single stator coil which is arranged laterally with respect to the motor rotor. The motor stator and the motor electronics are arranged in the dry motor chamber. The coolant pump comprises a pump wheel which is arranged in the pumping chamber and which is co-rotatably connected with the motor rotor by an axially extending rotor shaft so that the pump wheel is driven by the electric motor.

The stator coil arrangement is provided axially adjacent to a volute cooling sector of the pump volute. The stator coil arrangement is in thermal contact with the separation sidewall, in particular with a cooling section of the separation sidewall which is defined by the volute cooling sector, so that the stator coil arrangement is cooled by the coolant being pumped through the pump volute and flowing along the sidewall cooling section. The sidewall cooling section area is, however, relatively small. At least parts of the stator coil arrangement which is located radially further outside with respect to the volute cooling sector are therefore not cooled efficiently so that this stator coil arrangement heats up relatively quickly. The higher the temperature of the stator coil arrangement is, the lower is its electromagnetic efficiency. The stator coil arrangement must therefore be driven with a higher drive energy to achieve a predefined motor performance, which in turn increases the heat being generated in the stator coil arrangement. The higher drive energy also causes additional heating of the motor electronics which provides the drive energy to the stator coil arrangement. The electric motor and, in particular, the motor electronics can therefore overheat which can cause a malfunction or even a failure of the electric coolant pump.

SUMMARY

An aspect of the present invention is to provide a compact and reliable electric coolant pump with a high pump performance.

In an embodiment, the present invention provides an electric coolant pump which includes a pump housing, an electric motor, and a pump wheel. The pump housing comprises a pumping chamber which is filled with a coolant during a pump operation and a motor chamber which is fluidically separated from the pumping chamber by a separation sidewall which extends substantially in a radial plane. The pumping chamber comprises a radially inner pump inlet, a radially outer pump outlet, and a pump volute which extends from downstream of the radially inner pump inlet to the radially outer pump outlet. The pump volute comprises a volute cooling sector which extends over a volute angle of 120° starting at the radially outer pump outlet. The separation sidewall comprises a cooling section which is defined by the volute cooling sector. The electric motor comprises a rotatable motor rotor, a static motor stator comprising a single compact stator coil arrangement which is arranged laterally with respect to the rotatable motor rotor in the motor chamber, and a motor electronics which is arranged in the motor chamber and which is configured to energize the single compact stator coil arrangement. The pump wheel is arranged in the pumping chamber. The pump wheel is co-rotatably connected with the rotatable motor rotor. The single compact stator coil arrangement is arranged axially adjacent to the volute cooling sector of the pump volute and in a thermal contact with the cooling section of the separation sidewall.

BRIEF DESCRIPTION OF THE DRAWINGS

The present invention is described in greater detail below on the basis of embodiments and of the drawings in which.

DETAILED DESCRIPTION

Figure 1:
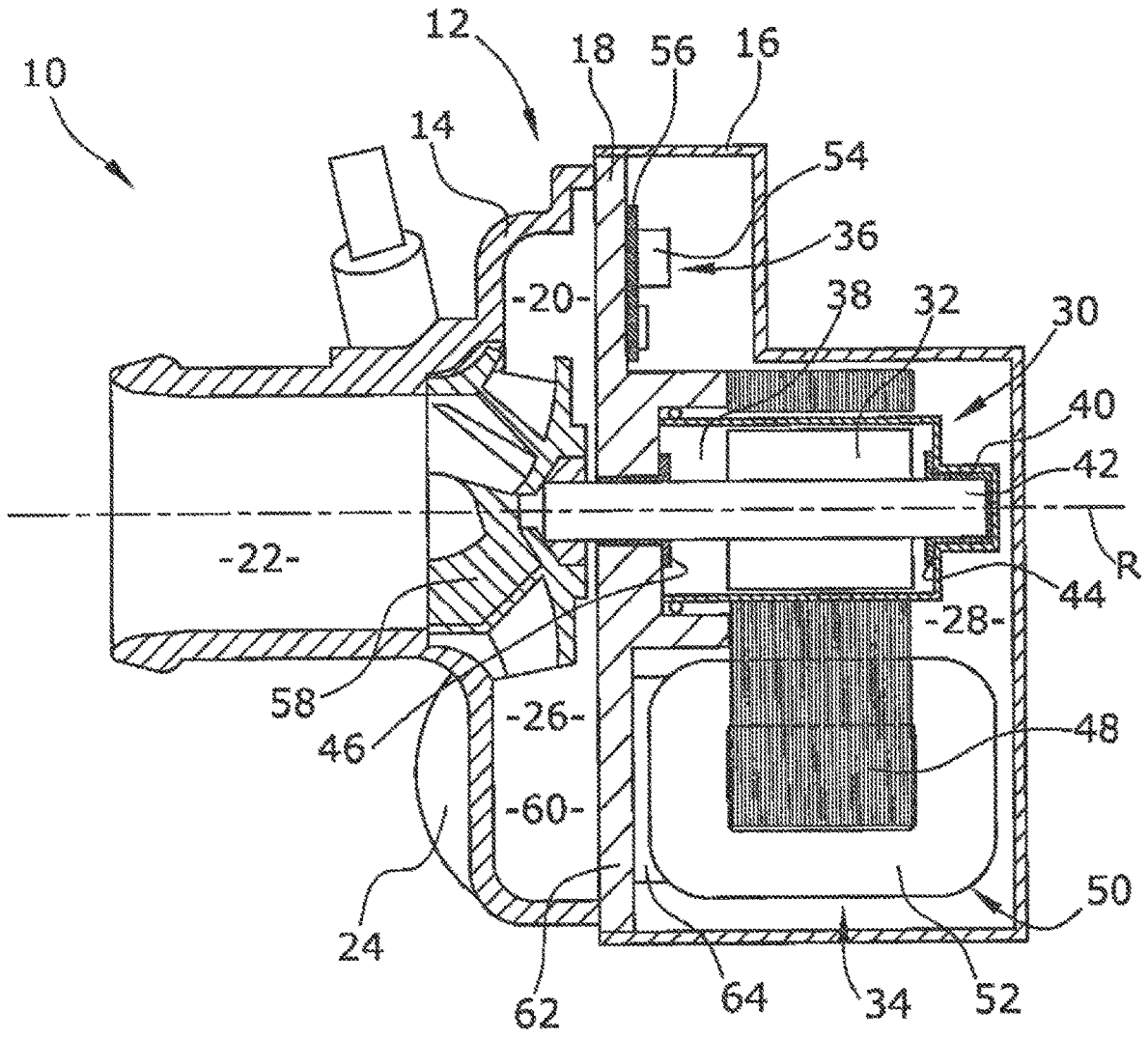
FIG. 1 shows a schematic partially sectioned side view of an electric coolant pump according to the present invention.
Figure 2:
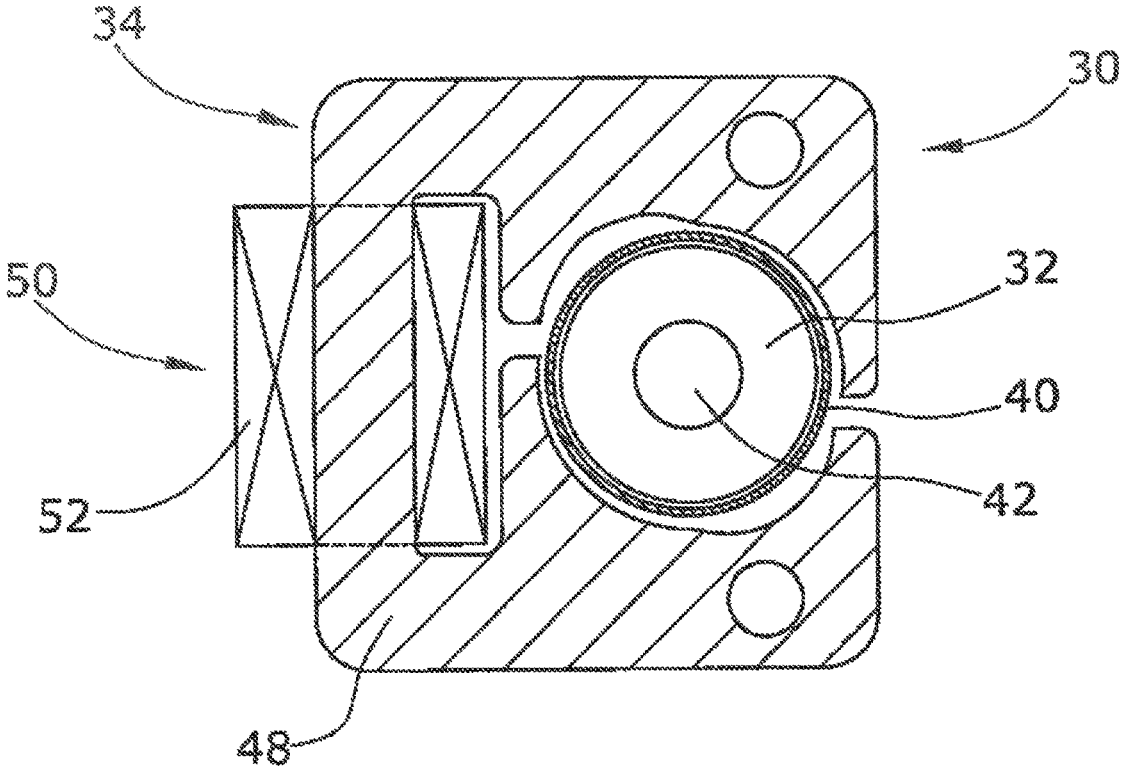
FIG. 2 shows a schematic partially sectioned top view of an electric motor of the coolant pump of FIG. 1.
Figure 3:
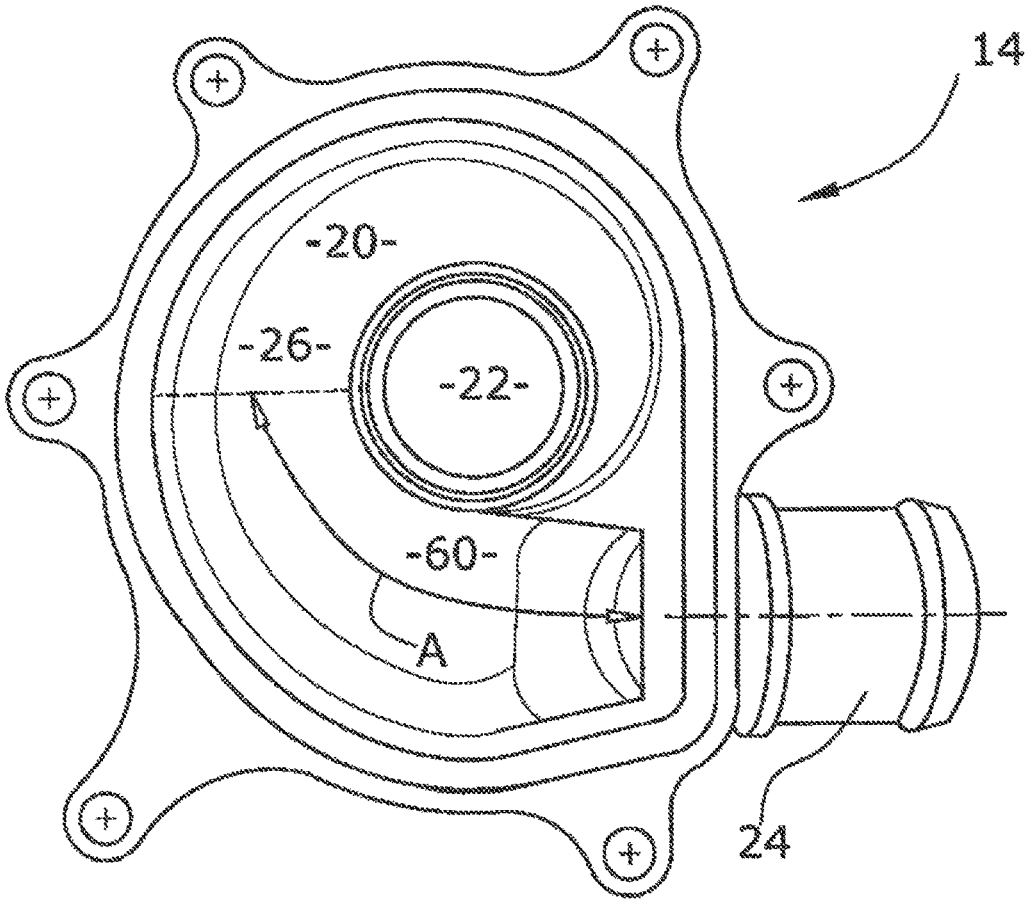
FIG. 3 shows a schematic top view of a pumping chamber cover of the coolant pump of FIG. 1.

The electric coolant pump according to the present invention is provided with a pump housing which defines a pumping chamber and a motor chamber which are both fluidically separated from each other by a separation sidewall which extends substantially in a radial plane. The pumping chamber is filled with a liquid coolant during pump operation and comprises a radially inner pump inlet and a radially outer pump outlet. The pump inlet can, for example, substantially extend in an axial motor direction and the pump outlet can, for example, substantially extend in a radial plane so that the pump inlet extends substantially perpendicular with respect to the pump outlet. The pump inlet and the pump outlet are fluidically connected by a pump volute which extends from downstream of the pump inlet to the pump outlet in a radial plane. The flow cross section of the pump volute increases from the pump inlet to the pump outlet to provide an efficient coolant discharge.

The electric coolant pump comprises an electric motor with a rotatable motor rotor, a static motor stator, and a motor electronics for energizing the stator coil arrangement. The rotatable motor rotor is magnetically driven by the motor stator. The motor rotor can, for example, be permanent-magnetic so that no wear-prone sliding contacts are required to electromagnetically magnetize the motor rotor. The electric components, i.e., the motor electronics and the electromagnetic motor stator, are sensitive to the coolant and are therefore arranged in the dry motor chamber.

The motor stator is provided with a single compact stator coil arrangement which can be defined by a single stator coil or which can comprise several stator coils. All stator coils of the stator coil arrangement are in any case arranged concentrated in a compact cluster, i.e., all stator coils are arranged in a direct vicinity to each other. The stator coil arrangement is arranged laterally with respect to the motor rotor so that all stator coils of the stator coil arrangement are arranged on the same side of the motor rotor. The stator coils are not distributed along the circumference of the motor rotor. Only a small space is therefore required for the stator coil arrangement.

The electric coolant pump is provided with a pump wheel being co-rotatably connected with the motor rotor so that the pump wheel is driven by the electric motor. The pump wheel can be provided integrally with the motor rotor or, alternatively, can be co-rotatably connected with the motor rotor, for example, by a rotor shaft. The pump wheel is arranged in the pumping chamber for pumping the coolant from the pump inlet through the pump volute to the pump outlet. The pump wheel can, for example, be located in the radial center of the pump volute so that the coolant entering the pumping chamber via the, for example, axial pump inlet flows substantially axially against the pump wheel and is accelerated radially outwardly by the rotating pump wheel.

According to the present invention, the stator coil arrangement is located axially adjacent to a volute cooling sector of the pump volute. The volute cooling sector defines a sidewall cooling section which axially separates the volute cooling sector from the motor chamber. The sidewall cooling section is cooled by the coolant flowing through the volute cooling sector. The stator coil arrangement is in thermal contact with the sidewall cooling section, i.e., there is no air gap between the stator coil arrangement and the sidewall cooling section. The stator coil arrangement can thus be cooled by the coolant being pumped through the pump volute.

The volute cooling sector extends over a volute angle of 120° starting at the pump outlet, i.e., the volute cooling sector is located at the pump outlet. The volute cooling sector therefore defines a relatively large sidewall cooling section area because the flow cross section of the pump volute increases from the pump inlet to the pump outlet. This provides an efficient cooling of the entire stator coil arrangement which reduces the temperature of stator coil arrangement and the heat being dissipated by the stator coil arrangement into the motor chamber.

The reduced stator coil arrangement temperature improves the electric conductivity and therefore the electromagnetic efficiency of the stator coil arrangement so that a lower driving energy is required to achieve a predetermined pump performance. This reduces the waste heat generation in the motor electronics. The reduced waste heat generation in the motor electronics and the reduced heat dissipation of the stator coil arrangement into the motor chamber avoid an overheating of the motor electronics. The improved electromagnetic efficiency also provides a higher pump performance for a predetermined driving energy. The electric coolant pump according to the present invention can therefore reliably provide a high mechanical pump performance.

Beside of the higher electric conductivity of the stator coil arrangement, the efficient cooling of the stator coil arrangement also allows more heat to be dissipated via the sidewall cooling section into the coolant so that more heat can be generated in the stator coil arrangement without overheating the stator coil arrangement. The efficient cooling of the stator coil arrangement therefore allows the coil wire cross section of the stator coil arrangement to be reduced without losing motor efficiency and without overheating the stator coil arrangement. This provides a more compact stator coil arrangement and thereby a compact electric motor.

The stator coil arrangement can, for example, be defined by a single stator coil which is arranged laterally and satellite-like with respect to the motor rotor. The single stator coil provides a very compact realization of the stator coil arrangement and therefore of the electric coolant pump. The single stator coil can also be easily arranged axially adjacent to and in thermal contact with the sidewall cooling section.

In an embodiment of the present invention, the thermal contact between the stator coil arrangement and the sidewall cooling section can, for example, be provided by a heat transfer element being arranged axially between and in direct contact with the sidewall cooling section and the stator coil arrangement. The heat transfer element is provided with a high thermal conductivity of at least 1 W/(m·K). The heat transfer element can, for example, be relatively flexible so that the heat transfer element can be adapted to the contour of the stator coil arrangement. This allows for a large contact area between the heat transfer element and the stator coil arrangement and, as a result, provides for a very efficient heat dissipation from the stator coil arrangement via the heat transfer element and the sidewall cooling section into the coolant and thereby an efficient cooling of the stator coil arrangement.

At least the cooling section of the separation sidewall can, for example, be made of a material with a high thermal conductivity, for example, of aluminum. The thermal conductivity of the sidewall cooling section material can, for example, be higher than 10 W/(m·K), however, the thermal conductivity is at least higher than that of plastic materials. This allows for an efficient heat transfer from the stator coil arrangement via the sidewall cooling section into the coolant and thereby an efficient cooling of the stator coil arrangement.

Since significant heat is generated in the motor electronics during the motor operation, sufficient cooling of the motor electronics is required to avoid a malfunction or damage of the motor electronics and thereby to avoid a failure of the electric coolant pump. In an embodiment of the present invention, the motor electronics can, for example, be provided to be in thermal contact with the separation sidewall so that the motor electronics is cooled by the coolant being pumped through the coolant pump. This provides a reliable electric motor and thereby a reliable electric coolant pump. The geometry of the motor electronics can, for example, be adapted to the geometry of the pump volute so that the entire motor electronics can be provided to be in thermal contact with the separation sidewall.

The motor rotor can, for example, be arranged in a rotor chamber which is fluidically separated from the motor chamber by a separation can. The separation can extends through the air gap between the motor rotor and the motor stator and is made of a material which is permeable for the magnetic field generated by the motor stator. The rotor chamber need not be sealed against the pumping chamber since the rotor chamber is fluidically separated from the motor chamber. This allows for a simple co-rotatable connection of the motor rotor with the pump wheel which does not require any complex sealing elements which are expensive and liable to wear.

An embodiment of the present invention is described below under reference to the enclosed drawings.

The electric coolant pump 10 comprises a multi-part pump housing 12 with a pumping chamber cover element 14, a motor chamber cover element 16, and a separation sidewall 18 which substantially extends in a radial plane. In the shown embodiment of the present invention, the separation sidewall 18 is made of a material with a high thermal conductivity, for example, of aluminum. The pumping chamber cover element 14 and the separation sidewall 18 define a pumping chamber 20 which is filled with a coolant during pump operation. The pumping chamber 20 comprises a radially inner pump inlet 22, a radially outer pump outlet 24, and a pump volute 26 which extends from downstream of the pump inlet 22 to the pump outlet 24 in a radial plane. The pump inlet 22 extends substantially in an axial motor direction, and the pump outlet 24 extends substantially in a radial plane, so that the pump inlet 22 is arranged substantially perpendicular with respect to the pump outlet 24. The flow cross section of the pump volute 26 increases from the pump inlet 22 to the pump outlet 24. The motor chamber cover element 16 and the separation sidewall 18 define a motor chamber 28 which is fluidically separated from the pumping chamber 20 by the separation sidewall 18.

The electric coolant pump 10 comprises an electric motor 30 with a rotatable permanent-magnetic motor rotor 32, a static electromagnetic motor stator 34, and a motor electronics 36 for energizing the motor stator 34. The motor rotor 32 is located in a rotor chamber 38 which is fluidically separated from the motor chamber 28 by a separation can 40. The motor stator 34 and the motor electronics 36 are arranged in the dry motor chamber 28.

The motor rotor 32 is co-rotatably fixed to a rotor shaft 42 which is rotatable about an axis of rotation R. The rotor shaft 42 is rotatably supported in the separation can 40 and in the separation sidewall 18 by two suitable shaft bearings 44,46. The rotor shaft 42 extends axially from the rotor chamber 38 into the pumping chamber 20.

The motor stator 34 is provided with a laminated stator body 48 and with a single electromagnetic stator coil arrangement 50. In the shown embodiment of the present invention, the stator coil arrangement 50 is defined by a single stator coil 52 which is arranged laterally and satellite-like with respect to the motor rotor 32. The stator coil arrangement 50 is electrically connected with and is energized by the motor electronics 36. The stator coil arrangement 50 and the motor electronics 36 are arranged diametrically opposite with respect to the motor rotor 32.

The motor electronics 36 comprises several power semiconductors 54 which are arranged on a printed circuit board 56. In the shown embodiment of the present invention, the printed circuit board 56 of the motor electronics 36 is in direct thermal contact with the separation sidewall 18 so that the motor electronics 36 is cooled by the coolant being pumped through the pump volute 26.

The electric coolant pump 10 comprises a pump wheel 58 which is located in the pumping chamber 20 for pumping the coolant from the pump inlet 22 through the pump volute 26 to the pump outlet 24. The pump wheel 58 is co-rotatably connected with the rotor shaft 42 so that the pump wheel 58 is driven by the electric motor 30. The pump wheel 58 is arranged within the pumping chamber 20 so that the coolant entering the pumping chamber 20 via the pump inlet 22 flows substantially axially against the pump wheel 58 and is accelerated radially outwardly by the rotating pump wheel 58.

The stator coil arrangement 50 is located axially adjacent to a volute cooling sector 60 of the pump volute 26. The volute cooling sector 60 extends over a volute angle A=120° starting at the pump outlet 24 and running in a pump-inlet-facing circumferential direction of the pump volute 26. The volute cooling sector 60 defines a sidewall cooling section 62 which axially limits the volute cooling sector 60 towards the motor chamber 28. The sidewall cooling section 62 is cooled by the coolant flowing through the volute cooling sector 60.

The stator coil arrangement 50 is laterally positioned within the lateral extent of the sidewall cooling section 62. A heat transfer element 64 is arranged axially between the sidewall cooling section 62 and the stator coil arrangement 50. The heat transfer element 64 is made of a flexible material with a high thermal conductivity. In the shown embodiment of the present invention, the heat transfer element 64 is a commercially available thermal pad with a thermal conductivity of a least 1 W/(m·K). The heat transfer element 64 is in a direct large-area contact with the sidewall cooling section 62 and the stator coil arrangement 50 so that the heat transfer element 64 provides a thermal contact between the stator coil arrangement 50 and the sidewall cooling section 62. The stator coil arrangement 50 is thereby efficiently cooled by the coolant being pumped through the pump volute 26 during pump operation.

The present invention is not limited to embodiments described herein; reference should be had to the appended claims.

LIST OF REFERENCE NUMERALS

10 electric coolant pump
12 pump housing
14 pumping chamber cover element
16 motor chamber cover element
18 separation sidewall
20 pumping chamber
22 pump inlet
24 pump outlet
26 pump volute
28 motor chamber
30 electric motor
32 motor rotor
34 motor stator
36 motor electronics
38 rotor chamber
40 separation can
42 rotor shaft

44 shaft bearing
46 shaft bearing
48 stator body
50 stator coil arrangement
52 single stator coil
54 power semiconductors
56 printed circuit board
58 pump wheel
60 volute cooling sector
62 sidewall cooling section
64 heat transfer element
A volute angle

What is claimed is:

1. An electric coolant pump comprising:
a pump housing comprising,
a pumping chamber which is filled with a coolant during a pump operation, the pumping chamber comprising,
a radially inner pump inlet,
a radially outer pump outlet, and
a pump volute which extends from downstream of the radially inner pump inlet to the radially outer pump outlet, the pump volute comprising a volute cooling sector, and
a motor chamber which is fluidically separated from the pumping chamber by a separation sidewall which extends substantially in a radial plane, the separation sidewall comprising a cooling section which is defined by the volute cooling sector;
an electric motor comprising,
a rotatable motor rotor,
a static motor stator comprising a single compact stator coil arrangement comprising at least one stator coil and being arranged laterally with respect to the rotatable motor rotor in the motor chamber, and
a motor electronics which is arranged in the motor chamber and which is configured to energize the single compact stator coil arrangement; and
a pump wheel arranged in the pumping chamber, the pump wheel being co-rotatably connected with the rotatable motor rotor,
wherein,
the single compact stator coil arrangement is arranged axially adjacent to the volute cooling sector of the pump volute and in a thermal contact with the cooling section of the separation sidewall, and
each of the at least one stator coil is arranged on a same side of the motor rotor as the pump outlet.

2. The electric coolant pump as recited in claim 1, wherein the single compact stator coil arrangement is defined by a single stator coil.

3. The electric coolant pump as recited in claim 1, further comprising:
a heat transfer element which is arranged axially between the cooling section of the separation sidewall and the single compact stator coil arrangement and which is in a direct contact with each of the cooling section of the of the separation sidewall and the single compact stator coil arrangement, the heat transfer element being configured to provide the thermal contact between the single compact stator coil arrangement and the sidewall cooling section.

4. The electric coolant pump as recited in claim 1, wherein the cooling section of the separation sidewall is made of a material having a high thermal conductivity.

5. The electric coolant pump as recited in claim 1, wherein the motor electronics is arranged to be in a thermal contact with the separation sidewall.

6. The electric coolant pump as recited in claim 1, further comprising:
a separation can; and
a rotor chamber which is fluidically separated from the motor chamber by the separation can, the rotatable motor rotor being arranged in the rotor chamber.

7. The electric coolant pump as recited in claim 1, wherein the entirety of the single compact stator coil arrangement and the entirety of the motor electronics are arranged on opposite sides with respect to the rotatable motor rotor.

8. The electric coolant pump as recited in claim 4, wherein the high thermal conductivity is at least 10 W/(m·K).

9. An electric coolant pump comprising:
a pump housing comprising,
a pumping chamber which is filled with a coolant during a pump operation, the pumping chamber comprising,
a radially inner pump inlet,
a radially outer pump outlet, and
a pump volute which extends from downstream of the radially inner pump inlet to the radially outer pump outlet, the pump volute comprising a volute cooling sector, and
a motor chamber which is fluidically separated from the pumping chamber by a separation sidewall which extends substantially in a radial plane, the separation sidewall comprising a cooling section which is defined by the volute cooling sector;
an electric motor comprising,
a rotatable motor rotor,
a static motor stator comprising a single compact stator coil arrangement comprising at least one stator coil and being arranged laterally with respect to the rotatable motor rotor in the motor chamber, and
a motor electronics which is arranged in the motor chamber and which is configured to energize the single compact stator coil arrangement; and
a pump wheel arranged in the pumping chamber, the pump wheel being co-rotatably connected with the rotatable motor rotor,
wherein,
the single compact stator coil arrangement is arranged axially adjacent to the volute cooling sector of the pump volute,
each of the at least one stator coil is arranged on a same side of the motor rotor as the pump outlet, and
the single compact stator coil arrangement is in a thermal contact with the cooling section of the separation sidewall so that no air gap exists between the single compact stator coil arrangement and the cooling section of the separation sidewall, or
the electric coolant pump further comprises a heat transfer element which is arranged axially between the cooling section of the separation sidewall and the single compact stator coil arrangement, the heat transfer element being in a direct thermal contact with each of the cooling section of the separation sidewall and with the single compact stator coil arrangement.

* * * * *